United States Patent [19]

Raschke

[11] 4,031,817

[45] June 28, 1977

[54] CARTON HANDLING APPARATUS

[76] Inventor: Josef Raschke, Sommerhausstrasse 11, 8011 Gelting, Germany

[22] Filed: July 29, 1975

[21] Appl. No.: 600,126

[52] U.S. Cl. ..... 93/44.1 R; 93/53 R

[51] Int. Cl.[2] ..... B31B 1/32

[58] Field of Search ..... 93/44.1 R, 51.1, 44.1 GT, 93/44, 39.2, 39.3, 12 R, 53 R, 36 R, 49 R; 53/374

[56] References Cited

UNITED STATES PATENTS

| | | | |
|---|---|---|---|
| 813,773 | 2/1906 | Casella | 93/44.1 R X |
| 1,179,959 | 4/1916 | Palmer et al. | 93/44.1 R |
| 2,887,022 | 5/1959 | Lubersky et al. | 93/53 SD |
| 3,093,035 | 6/1963 | Gentry et al. | 93/44.1 R |
| 3,188,926 | 6/1965 | Fortriede | 93/44.1 R |

FOREIGN PATENTS OR APPLICATIONS

| | | | |
|---|---|---|---|
| 1,258,499 | 4/1960 | France | 93/44.1 R |

*Primary Examiner*—James F. Coan
*Attorney, Agent, or Firm*—Fitzpatrick, Cella, Harper & Scinto

[57] ABSTRACT

Apparatus for handling cartons of paperboard and the like has at least two diametrically opposite holders, means for moving the holders in a circular path and means for moving same into and out of unfolded cartons to fix and carry the cartons. The diametrically opposed holders are arranged to be controlled for movement in opposite directions by a common control device.

8 Claims, 1 Drawing Figure

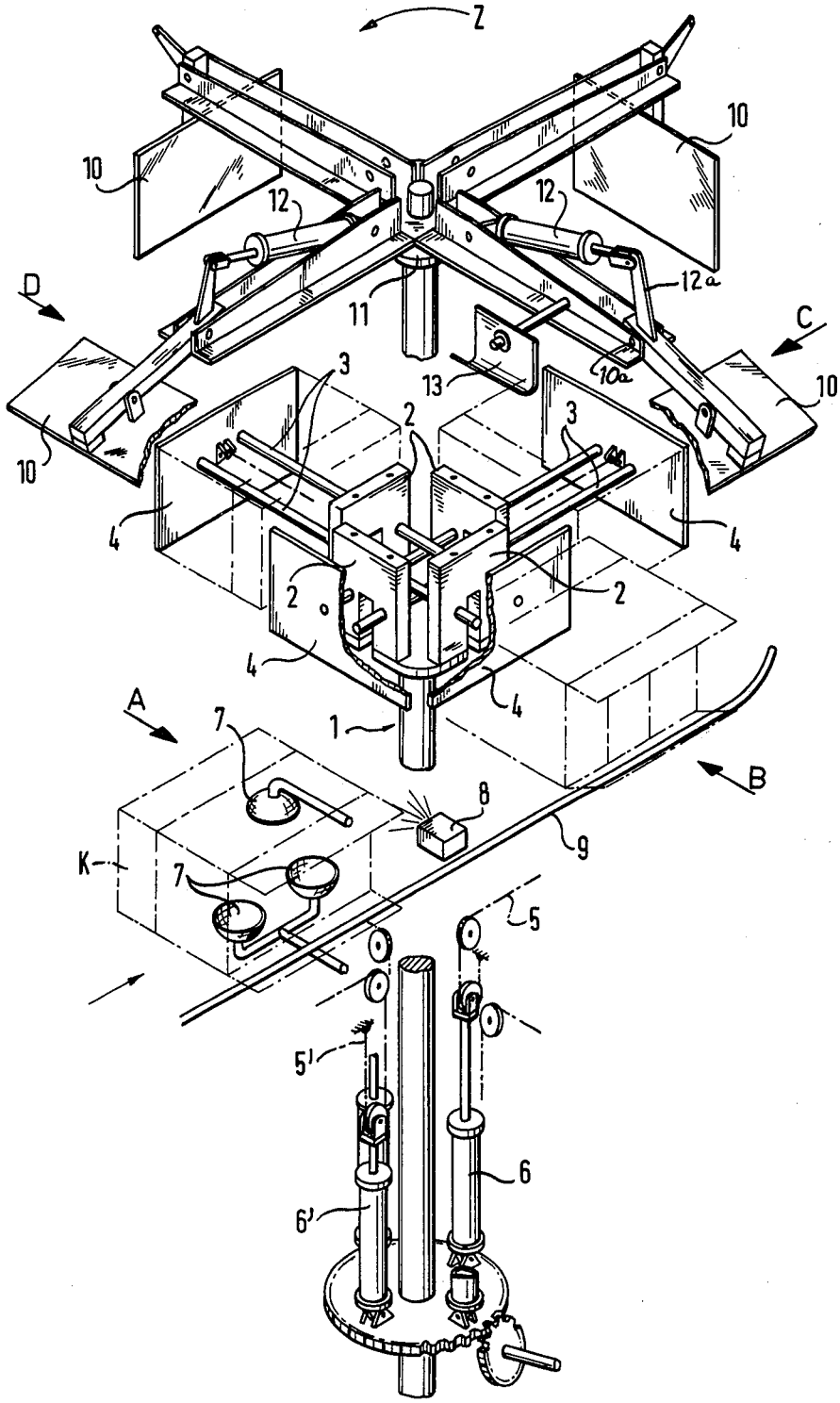
Z
10
10
12
12
12a
D
C
11
13
10a
10
10
3
3
2
2
2
4
4
4
4
A
7
1
B
8
9
K
7
5
5'
6
6'

CARTON HANDLING APPARATUS

The present invention relates to apparatus for handling cartons of paperboard and the like, and more particularly, to such apparatus for the unfolding, folding and closing, and if desired, gluing of the flaps of the bottoms of tops of such cartons by machine.

In one known type of such apparatus, each carton is guided linearly to individual working stations at which, in succession, the carton blank is set up, the transverse flaps of the bottom or of the top are closed, the glue is applied to the transverse or longitudinal flaps, or to both sets of flaps, whereupon the longitudinal flaps are closed and are subjected to a pressing pressure in order to assure good bonding of the flaps and thus a reliable closing of the bottom or top of the carton. The known apparatus are of complicated structure with many moving parts and complicated control devices for the parts so that they are not only expensive and susceptible to trouble, but also have a relatively low output.

A second known type of such apparatus comprises a rotor disc with a horizontal shaft on which stationary receiving pins are arranged over which the unfolded cartons are placed. For each placing process, the rotor disc must be stopped. This apparatus has the disadvantage that repetitive and long stand-still times occur, and after each such period, large masses must be accelerated. Moreover, such apparatus is relatively noisy and vibrates a good deal and its output is relatively limited.

The known apparatus have the common disadvantage that the unfolded carton is not held accurately fixed while it passes through the individual working stations so that skewed cartons result which in turn causes difficulties in their further processing or in the filling thereof.

I have conceived by the present invention apparatus of the aforementioned type by which I am able to overcome the difficulties and disadvantages of the known devices mentioned above, which is of simple and trouble-free construction, and which has a substantially greater output than the known devices.

An important aspect of my invention resides in the provision of means whereby it is possible for the erected carton to be grasped in a precise manner so that its side walls are at right angles and the carton is properly aligned and remains fixed in this position until the bottom and top flaps have been reliably glued, after which deformation of the carton is no longer possible.

In accordance with the present invention, at least two diametrically arranged holders which are continuously moved together over a circular path are provided, one of which, at each moment can be moved into and out of an unfolded carton in order to fix it and carry it along, the holders being arranged for control in opposite directions on a common control device which is radially displaceable on the circular path.

The holders of the apparatus of the invention therefore serve to enter a carton immediately after it has been unfolded and to hold it in an accurately right-angular position of its side surfaces until the flaps of the bottom or top have been dependably glued, whereafter deformation of the carton is thereby prevented. According to the present invention, two diametric holders are operated by a simple common control device in the manner that, at the time that one holder must be introduced into a carton which has just been unfolded, the diametrically opposite holder can be moved out of the carton which has already been provided with a closed bottom or top.

From this extremely advantageous measure, the advantage is simultaneously obtained that the entire apparatus, in accordance with the invention, has only a few moving parts and that therefore extremely simple control means can be employed for them. For the same reason, the apparatus of the invention can be operated at speeds which cannot be attained by the known prior art machines so that an output of 3000 cartons per hour can be reached with the apparatus of the present invention while, as a rule, the limit output of the known prior art machines was about 1000 cartons per hour.

By the guiding of the carton on a circular path during the individual operations, it is advantageously possible easily and conveniently to arrange the individual working stations along this circular path.

As a whole, there is provided apparatus having a high output of accurately produced cartons which do not result in any problems in the further utilization of the cartons.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

Specific embodiments of the invention have been chosen for purposes of illustration and description, and are shown in the accompanying drawings, forming a part of the specification, wherein the sole FIG. of the drawing is a perspective exploded view of a preferred embodiment of my invention.

Referring now to the drawing, the apparatus comprises a rotary table 1 which is driven continuously and on which the corresponding working units are arranged, as will be explained below.

The rotary table carries four bearing members 2. Opposite pairs of bearing members 2 each serve for the displaceable guidance of two control rods 3 each pair supporting two diametrically opposite holders 4. The holders 4 are carried along accordingly by the rotary table 1 in the direction indicated by the arrow Z, and pass over a circular path. The two diametrically opposite holders 4 are displaceable radially in opposite direction with respect to this circular path, in a manner such that, as indicated diagramatically, a chain system including chains 5 and 5' respectively, acts on the two diametrically opposite holders 4. The chains 5 and 5' are actuated by suitably controlled pneumatic or hydraulic cylinders 6 and 6' respectively. It will be appreciated by those skilled in the art that a cam system may also be used to displace the holders 4.

An unfolding station A, a transfer station B, a closing station C, and an ejection station D, are arranged in the region of the rotary table 1. The exact construction of the individual building units of the apparatus will be described in further detail below in connection with the manner of operation of the apparatus.

At the folding station A, a carton blank K taken by a suitable means from a magazine (not shown), is unfolded in known manner. For this purpose, the unfolding station comprises suitably controlled suction devices 7 which grasp the carton blank and unfold it, as it lies on its larger side walls.

The carton K which has thus been unfolded is moved by a suitable conveyor device to the transfer station B. In this connection, a suitable adhesive can be applied to the flaps of the bottom of the carton K which are to be glued together by means of an adhesive applicator 8. Furthermore, either the longitudinal flaps or the transverse flaps of the carton K can be at least partially closed as the carton K is transported from the unfolding station A to the transfer station B, a closing ledge 9 being arranged in proper position for this purpose.

At the transfer station B, the holder 4 which is located in this position, moves from the side which is not to be closed into the inside of the carton so as to hold it fast in precisely the desired position in unfolded state, and to assume its further transportation to the working stations. The holder 4 moves into the carton K up to the height of the scoring of the flaps of the bottom or top which are to be closed, so that it also serves to fix the flaps in the closed position for the further operations.

Upon further rotation of the rotary table 1, the carton which has been taken up on the holder 4 and held in precise fixed position, passes into the closing station C in which the flaps of the carton are closed and possibly also pressed together so as to effect a good dependable bonding together of the flaps.

For this purpose, a closure plate 10 acting from the outside on the flaps is advisedly associated with each of the holders 4. In order to move each of these closing plates 10 along synchronously with the corresponding holder 4, the closing plates 10 are arranged on a turnstile 11 which is connected rigidly with the rotary table 1 for rotation therewith. The actuation of the closing plates 10 is effected in each case by means of a respective hydraulic cylinder 12 each mounted on an arm of the turnstile 11 and operable to pivot its respective plate 10 about a pivot axis 10*a* in the turnstile arm between closing and retracted positions. For this purpose, links 12*a* are pivotally connected at one end to each cylinder piston rod and, at its other end is connected to its associated plate 10. The corresponding control of the hydraulic cylinders 12, the hydraulic cylinders 6 and the other parts of the apparatus which are to be actuated, is effected via a suitable control device.

On the turnstile 11 there are furthermore provided drivers 13 at least one of which in each case is also associated with a holder 4. These drivers 13 additionally grasp the carton K present on the holder 4 from the outside whereby a particularly good guiding and carrying along of the carton K is assured.

The carton K, due to the dependable and exact closing of the flaps of its bottom or top, is now fixed so firmly in its precise right-angle shape that the holder 4 can be moved out of the carton K at the ejector station D. In this way, however, the holder which is diametrically opposite the said holder 4 simultaneously moves into the carton which has just been brought into the transfer station B and has already been unfolded.

The finished carton A is grasped at the ejector station D by a suitable device and removed from the operation.

While in the known apparatus, when cartons of different size are worked, entire structural units must be replaced, but with the apparatus described, it is merely necessary to replace the holders 4 corresponding to the size of carton to be worked.

I believe that the construction and operation of my novel carton folding and closing apparatus will now be understood and that the advantages thereof will be fully appreciated by those persons skilled in the art.

I claim:

1. Apparatus for the unfolding of cartons and closing the flaps of the bottoms or tops thereof, comprising: at least two diametrically opposite holders (4), means for moving said holders continuously together along a circular path, holder control means connected to said two holders comprising at least one control rod common to said holders and means moving said control means towards and away from the axis of said circular path whereby each holder moves alternately into a carton to be folded to fix and carry the carton along said circular path and out of the folded carton while the opposite holder moves synchronously out of and into a carton.

2. Apparatus according to claim 1, characterized by the fact that a rotary table (1) is provided on which holders and their control means are carried, and further including means rotatable with said table and formed with radial arms, each arm carrying a closing plate and the means for actuating said closing plate.

3. Apparatus according to claim 1, characterized by drive means (5,5') for the displacement of said control means (3), and means for actuating said drive means.

4. Apparatus according to claim 3, wherein said drive means includes flexible transmission means and pressure operated means for controlling said transmission means.

5. Apparatus according to claim 2, wherein said means for actuating said closing plate comprise pressure operated devices.

6. Apparatus according to claim 1, characterized by the fact that each holder (4) has associated with it an apparatus (10, 10*a*, 12, 12*a*) for closing the flaps of the carton, said device being moved along together with the carton.

7. Apparatus according to claim 6, characterized by the fact that each closing device (10, 10*a*, 12, 12*a*) comprises at least one closing plate (10) which acts on the carton flaps from the outside. .

8. Apparatus according to claim 1, characterized by the fact that each holder (4) has associated with it at least one driver (13) disposed to grasp the carton from the outside and which passes with its respective holder along the circular path of the holder.

* * * * *